US006477726B2

(12) United States Patent
Hernandez

(10) Patent No.: US 6,477,726 B2
(45) Date of Patent: Nov. 12, 2002

(54) MATTRESS SUPPORT AND METHOD

(76) Inventor: Carlos J. Hernandez, 20 Forest Lake Cir., Greensboro, NC (US) 27407

( * ) Notice: Subject to any disclaimer, the term of this patent is extended or adjusted under 35 U.S.C. 154(b) by 81 days.

(21) Appl. No.: 09/741,614

(22) Filed: Dec. 11, 2000

(65) Prior Publication Data

US 2001/0004777 A1 Jun. 28, 2001

Related U.S. Application Data

(63) Continuation-in-part of application No. 09/480,617, filed on Jan. 10, 2000, which is a continuation-in-part of application No. 09/301,242, filed on Apr. 28, 1999, now Pat. No. 6,134,728.

(51) Int. Cl.[7] ..... A47C 19/04

(52) U.S. Cl. ..... 5/200.1; 5/201; 5/202; 5/310; 5/185

(58) Field of Search ..... 5/174, 175, 178.1, 5/181, 185, 200.1, 201, 202, 236.1, 238, 312

(56) References Cited

U.S. PATENT DOCUMENTS

| | | | | | |
|---|---|---|---|---|---|
| 2,666,931 | A | * | 1/1954 | Clerc | 248/188.91 |
| 3,736,602 | A | * | 6/1973 | Miller | 5/176.1 |
| 5,894,614 | A | * | 4/1999 | Stroud | 5/200.1 |
| 6,289,535 | B1 | * | 9/2001 | Hernandez | 5/176.1 |

* cited by examiner

*Primary Examiner*—Michael F. Trettel

(57) ABSTRACT

Pivotal mattress support comprises a pair of pivotal longitudinal members for replacing conventional wooden slats. The terminal ends of each longitudinal member includes a thin flange for attachment to the side rails of a conventional bed frame to allow a mattress to rest substantially flush on the cleat of the side rail. In one embodiment an extendable leg provides additional support for the slats. Legs are included with the support and the height of the legs can be adjusted by hand while mounted to the mattress support. The method of use consists of pivoting the longitudinal members of the mattress support to accommodate the particular width of the side rails of a selected bed frame.

18 Claims, 17 Drawing Sheets

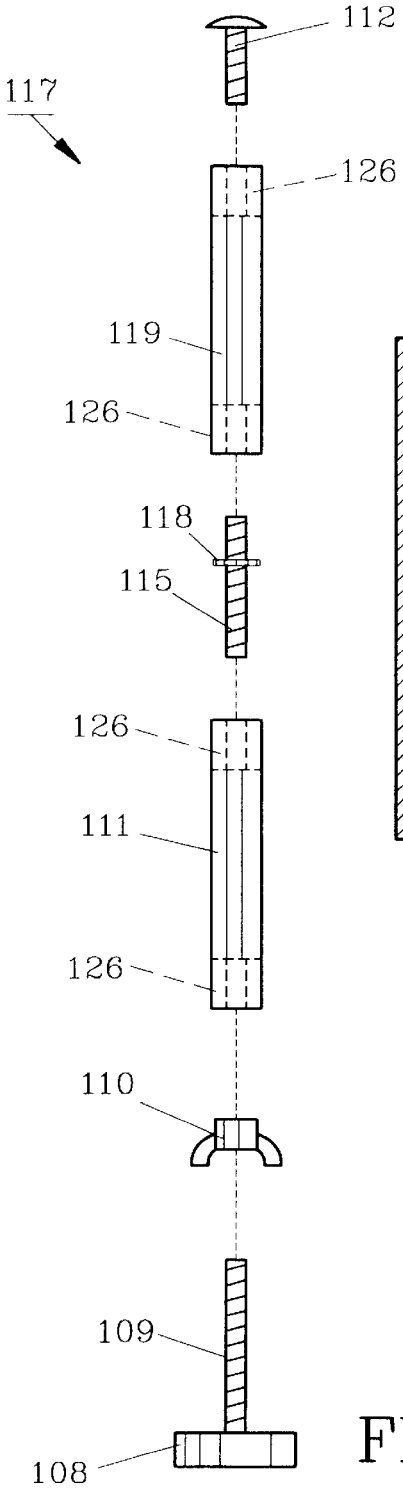
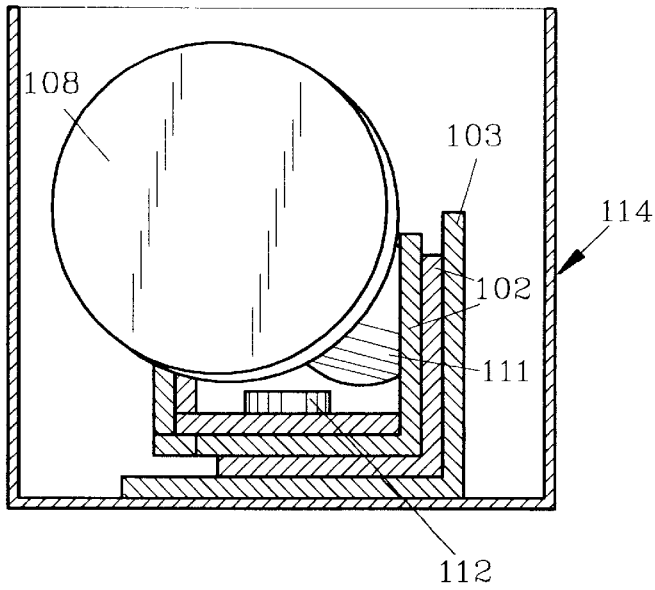
FIG. 19
FIG. 20

MATTRESS SUPPORT AND METHOD

This is a continuation in part of pending patent application Ser. No. 09/480,617 filed Jan. 10, 2000, which was a continuation in part of patent application Ser. No. 09/301,242 filed Apr. 22, 1999, now U.S. Pat. No. 6,134,728.

BACKGROUND OF THE INVENTION

1. Field of the Invention

This invention pertains to pivotal supports for extending between the two side rails of a conventional bed frame for supporting mattresses and/or box springs placed thereon.

2. Description of the Prior Art and Objectives of the Invention

While normal beds typically have two parallel side rails and wooden slats extending therebetween to support mattresses and box springs, this arrangement may lead to instability at the ends where the box springs are not supported by the wooden slats. Likewise, in the increasingly popular Hollywood frames, both ends of the box springs are similarly unsupported. In addition, wooden slats generally protrude above the bed rail cleats by the amount of their thickness and the box springs or mattress rest on the wooden slat.

In an attempt to address this potential instability, it is a purpose of the present invention to provide a mattress support which comprises a rigid, pivotal structure, whereby the arcuate pivoting action allows for adjustable positioning for bed frames of various widths.

It is a further objective of the present invention to provide a mattress support which has an extension to accommodate large distances between side rails as with California king size and other king size bed frames.

It is still a further objective of the present invention to provide a rigid, adjustable mattress support and method which incorporates height adjustable legs which can be adjusted by hand, without resort to tools, while the leg is attached to a fully installed mattress support.

It is yet another objective of the present invention to provide a mattress support that allows the box spring or mattress to substantially rest on the bed rail cleats.

It is also an objective of the present invention to provide a pivotal support which is easy to assemble and place in use quickly without resort to special tools or skills.

These and other objectives and advantages will become readily apparent to those skilled in the art upon reference to the following detailed description and accompanying drawing figures.

SUMMARY OF THE INVENTION

One embodiment of the invention provides two longitudinal members of equal length formed from angle iron which are connected to cooperate in a scissor-like motion to form an x-shaped mattress support or slat. Terminal ends of each longitudinal member include a flange to rest on the bed frame side rails. Each flange may include a hole therethrough for rigid affixation to the side rails if desired. The top longitudinal member includes a slot in its downward depending portion proximate the center of its length. Pivotally positioned in this slot is the second or bottom longitudinal member. A conventional bolt or screw allows the two longitudinal members to pivot relative to one another to effectuate the scissor-like motion desired. The slot approximately levels the upper surfaces of the two longitudinal members.

In an alternate configuration of the first embodiment described above, a central adjustable leg, as is conventional may be used to support the center of the x-shaped bed support. Likewise, it is foreseen using a plurality of x-shaped longitudinal members between two side rails to properly support a bed of unusual length. In still another configuration, one x-shaped slat includes selectively extendable extensions which allow the longitudinal members to conveniently extend between two side rails for a bed of unusual width such as a California king size bed.

In a second and preferred embodiment of the invention, a pair of slats, each with two longitudinal members of equal length for positioning in the shape of, for example, a "v", are pivotally connected to opposing ends of a center divider. The longitudinal members are made from angle iron and have a flat, upper horizontal portion and a downwardly depending portion. Terminal ends of each longitudinal member include a planar flange to rest on the bed frame side rails. Each flange includes a hole therethrough for rigid affixation to the side rails if desired by a bolt or screw. Each longitudinal member can arcuately pivot for ease in use on beds of different widths from approximately 35.5 inches (90 cm) in width to about 78 inches (198 cm). Furthermore, the longitudinal members can be pivoted so that they are parallel against the center divider to form a compact, linear shape that can be easily contained in a shipping box. A vertical, adjustable leg is removably affixed to the center divider at the intersection of the longitudinal members and at the approximate mid-point of the center divider. The height of the legs can be adjusted by hand with a wing nut, without resort to tools or special training, while attached.

The legs are preferably comprised of a circular base connected to a threaded member and a wing nut is threadably received on the threaded member. A tubular section having an upper end and a lower end is threadably connected at its lower end to the threaded member at a point above the wing nut. The height of the leg can be adjusted by threading the circular base into the tubular section which has a female threaded element within its interior capable of accepting the threaded member of the circular base. The wing nut is tightened against the tubular section at the selected location along the threaded member, thereby holding the tubular section in place relative to the circular base, keeping the height of the leg stable. If a longer leg is desired, a second tubular section can be threadably connected to the first tubular section via a female threaded element positioned in the upper end of the first tubular section and the lower end of the second tubular section.

In still another embodiment of the invention a pair of v-shaped pivotal slats are connected with a divider for supporting a pair of mattresses in side by side configuration.

The invention provides for a method of use comprising the steps of removing the apparatus from the box, attaching the legs to the center divider, adjusting the legs to the desired height, placing the apparatus in an upright position on the floor, pivoting the longitudinal members of the slats so as to form a suitable "v"-shape, tightening the pivotal connection between the slats and the center divider to hold the slats in place, and placing a mattress on the apparatus.

BRIEF DESCRIPTION OF THE DRAWINGS

FIG. 19 depicts an enlarged cross sectional view of the invention of FIG. 18 as along lines 19—19 therein; and FIG. 20 shows a schematic view of a preferred leg of the invention in enlarged, exploded fashion.

DETAILED DESCRIPTION OF THE PREFERRED AND OTHER EMBODIMENTS AND OPERATION OF THE INVENTION

Figure 1:
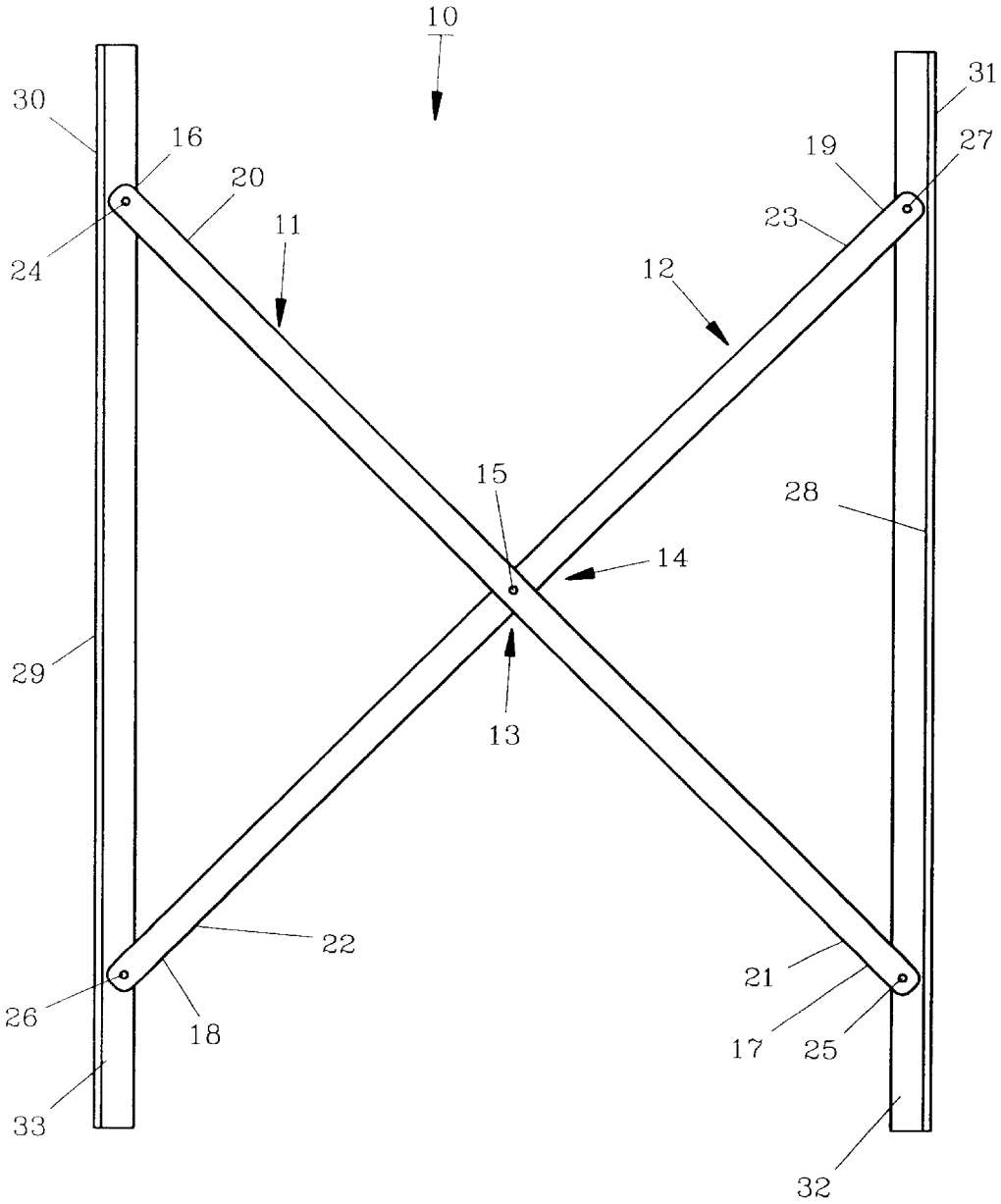
FIG. 1 shows a top view of one embodiment of the present invention as used between two side rails of a bed.

Turning now to the drawings, specifically FIG. 1 shows mattress support 10 which comprises first or top longitudinal member 11 and second or bottom longitudinal member 12 joined proximate center points 13 and 14 respectively by conventional threaded fastener 15. Longitudinal members 11 and 12 are preferably formed from conventional angle iron. At terminal ends 16–19 are flanges 20–23 (see also FIG. 2) which define holes 24–27 respectively. Holes 24–27 may be used with conventional fasteners (not shown) to more rigidly affix mattress support 10 to side rails 28 and 29 of a typical bed frame. In the accompanying method, mattress support 10 is pivoted into a suitable x-shaped width and extends between standard bed side rails 28 and 29, thus providing support proximate corners 30–33 to a conventional box spring (not shown).

Figure 2:
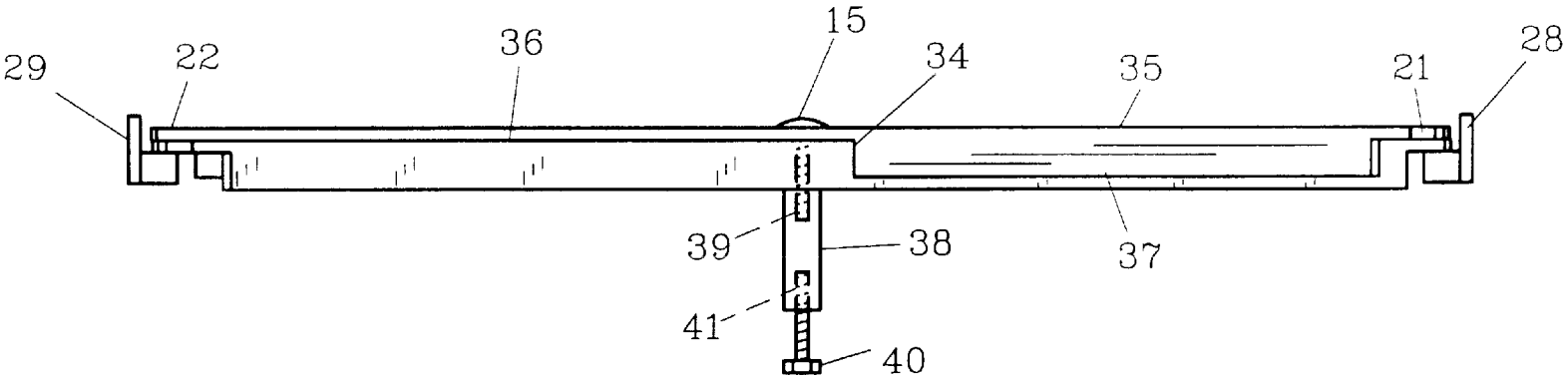
FIG. 2 illustrates an end view of the device of FIG. 1 with an optional support leg attached.

As seen in FIG. 2, top longitudinal member 11 includes slot 34 (see also FIG. 3) in depending portion 37 which bottom longitudinal member 12 fits within to level top surfaces 35 and 36 of longitudinal members 11 and 12 respectively. The opposite end view is a mirror image thereof. Fastener 15 may be a bolt and attach to optional support leg 38 by means of threaded channel 39. Threaded foot 40 may be positioned in threaded channel 41 to extend the length of foot 40 as needed.

Figure 3:
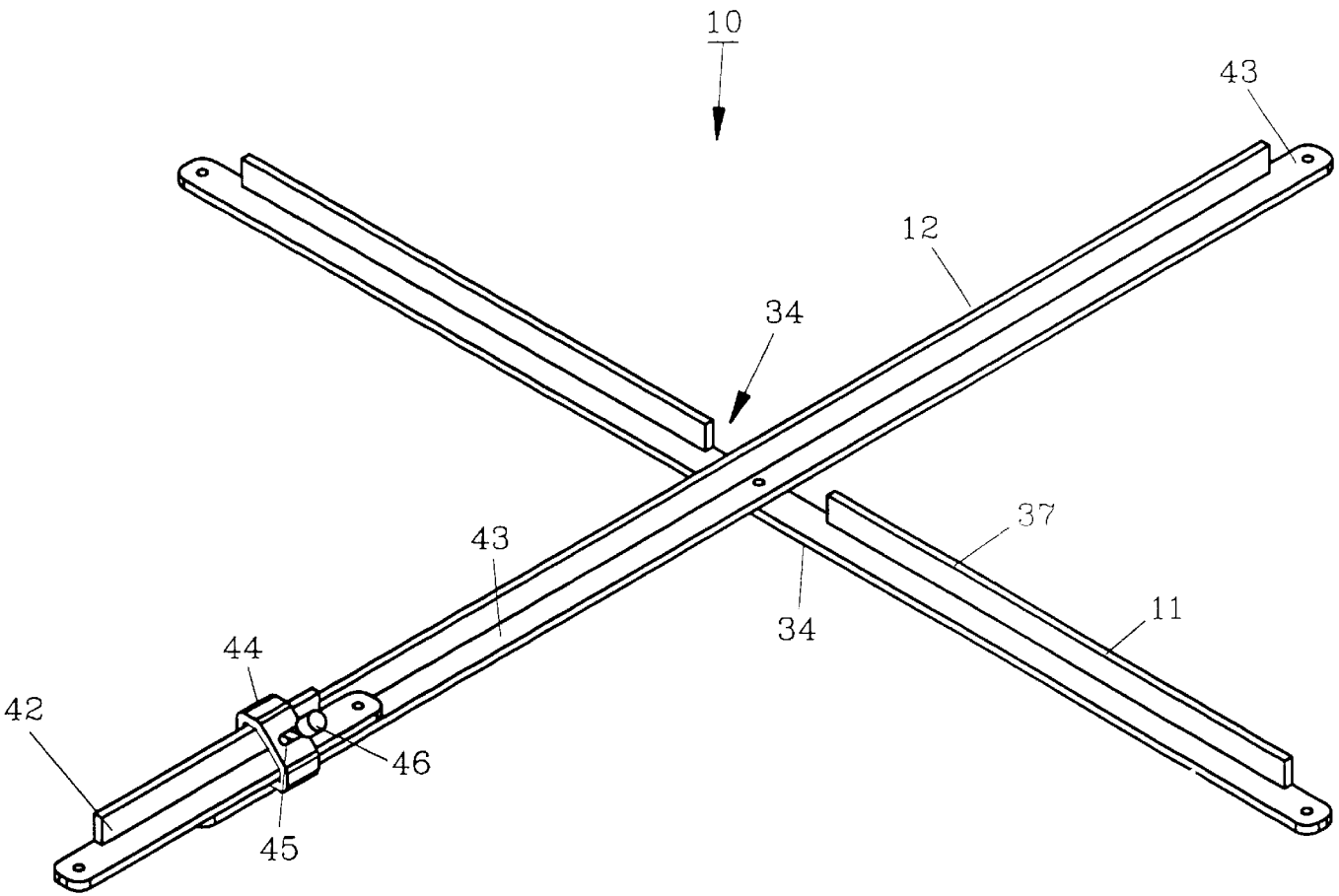
FIG. 3 (shown inverted) demonstrates one of the longitudinal members of the device of FIG. 1 with an optional extension member attached.
Figure 4:
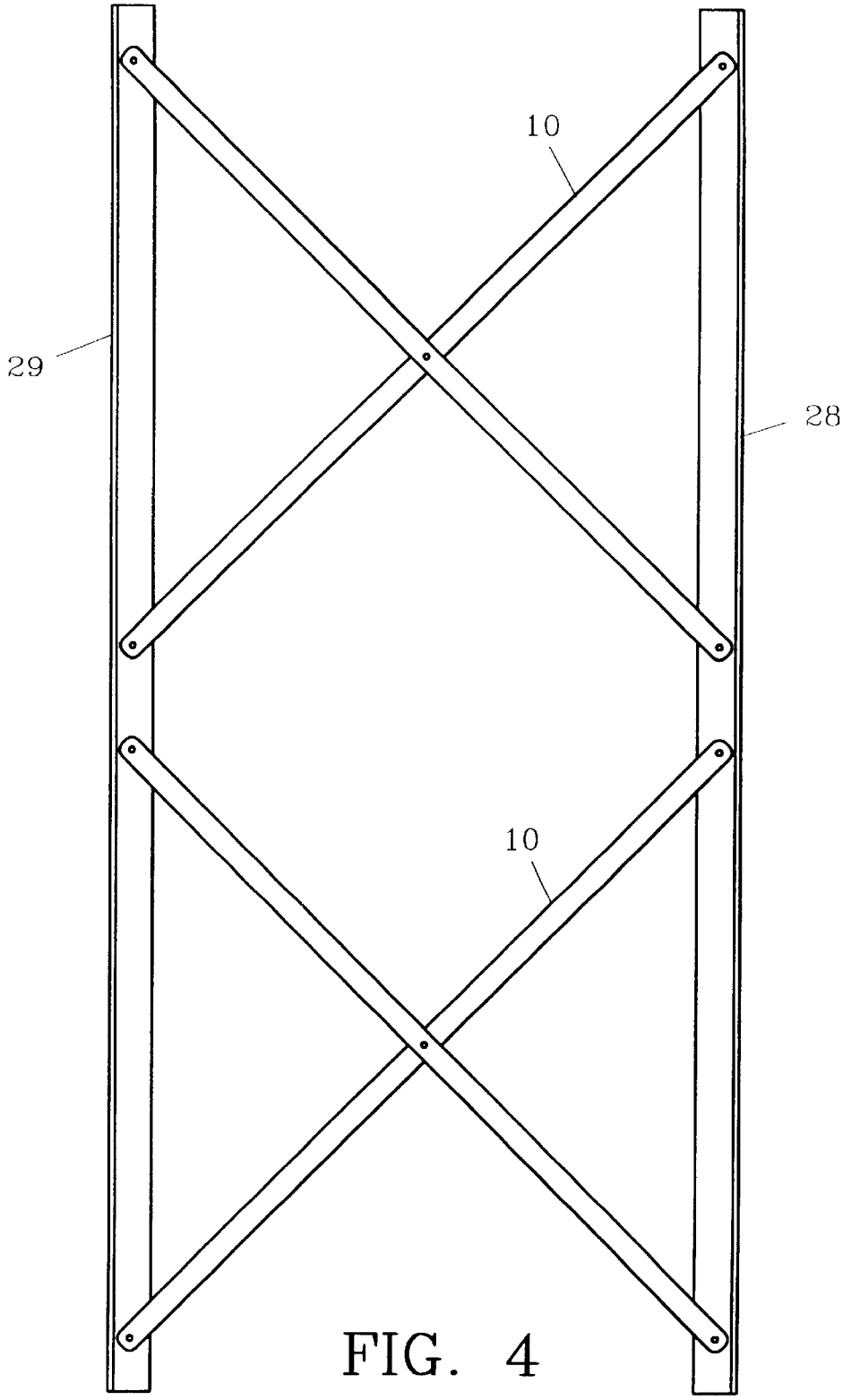
FIG. 4 features an alternate combination of bed frame rails and a plurality of x-shaped mattress supports.

In FIG. 3, seen without leg 38, longitudinal member 11 may include extension member 42, which is preferably formed of angle iron. Attaching device 44 is conventional as is commonly found on Hollywood bed frames and includes an open triangular shaped body with threaded aperture 45 and threaded fastener 46 passing therethrough. The fastener is tightened against extension 42 forcing it into tight frictional engagement with undersurface 43 of longitudinal member 12. This arrangement is well suited for use with exceptionally wide beds. FIG. 4 shows a plurality of mattress supports 10 as may be used to support a box spring (not shown) on a bed frame of unusual length.

Figure 5:
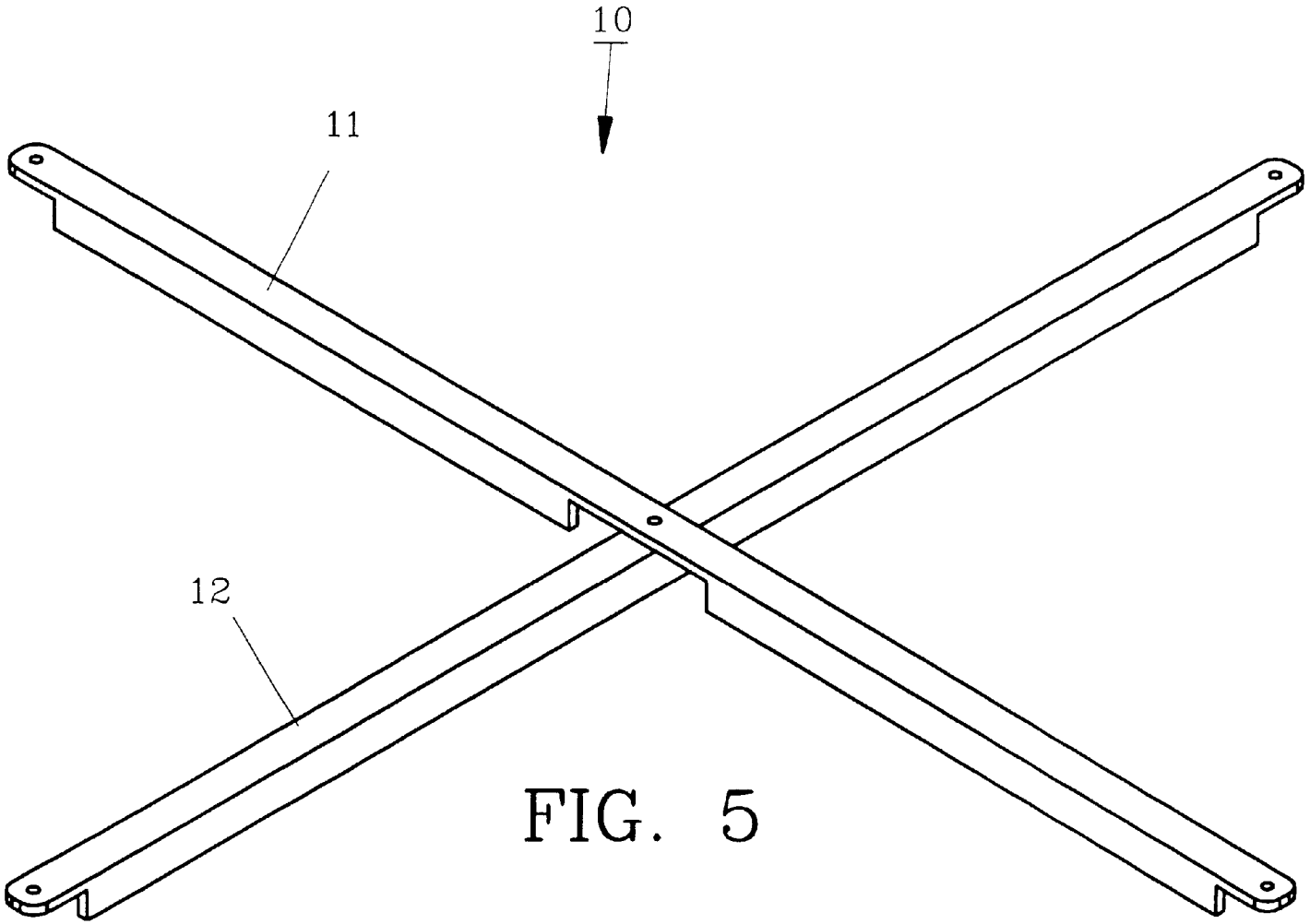
FIG. 5 depicts the device of FIG. 1 removed from the bed frame in a top perspective view.

FIG. 5 demonstrates in perspective fashion, a view of the top of mattress support 10 without leg 38 as seen along the right side thereof. It being understood that the left side would mirror this view.

Figure 6:
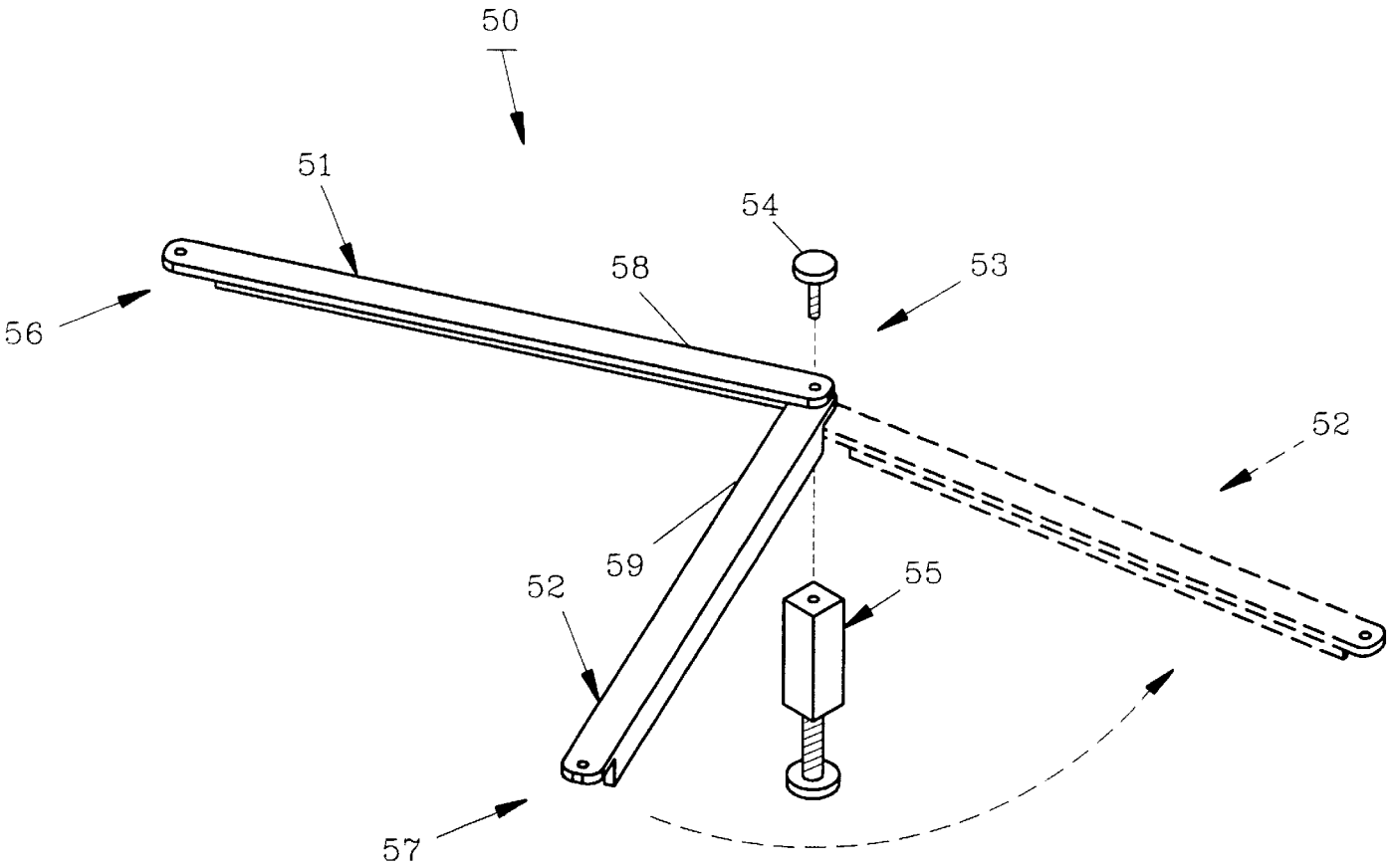
FIG. 6 presents an alternate v-shaped embodiment of the invention partially open, with dashed lines showing a wider opening as would be necessary for a wider bed.

In one alternate embodiment, pivotal v-shaped slat 50 is shown in FIG. 6 having a pair of longitudinal members 51, 52. As would be understood, a top or first longitudinal member 51 and second or bottom longitudinal member 52 are formed of angle iron for rigidity and are joined at intersection 53 by threaded member 54 which connects to a standard adjustable leg 55 (shown in exploded fashion). Longitudinal members 51 and 52 include distal ends respectively, 56, 57 and proximal ends 58, 59. In the method of use, distal ends 56, 57 are mounted to opposing bed rails by screws or other fasteners and one or more slats 50 may be employed, depending on the length of the bed and the rigid support required.

Figure 7:
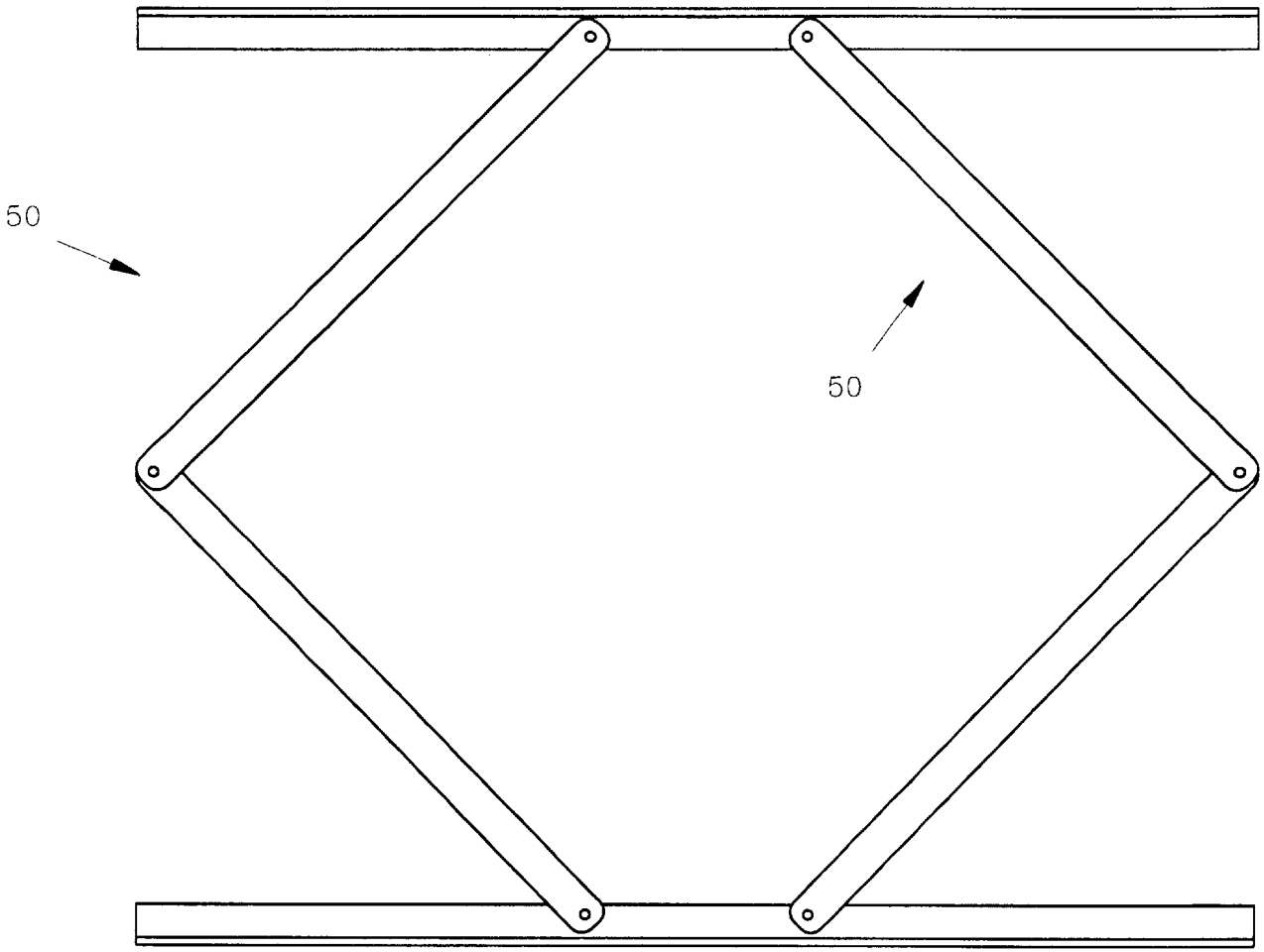
FIG. 7 demonstrates a pair of v-shaped slats as shown in FIG. 6 on a relatively wide bed frame.
Figure 8:
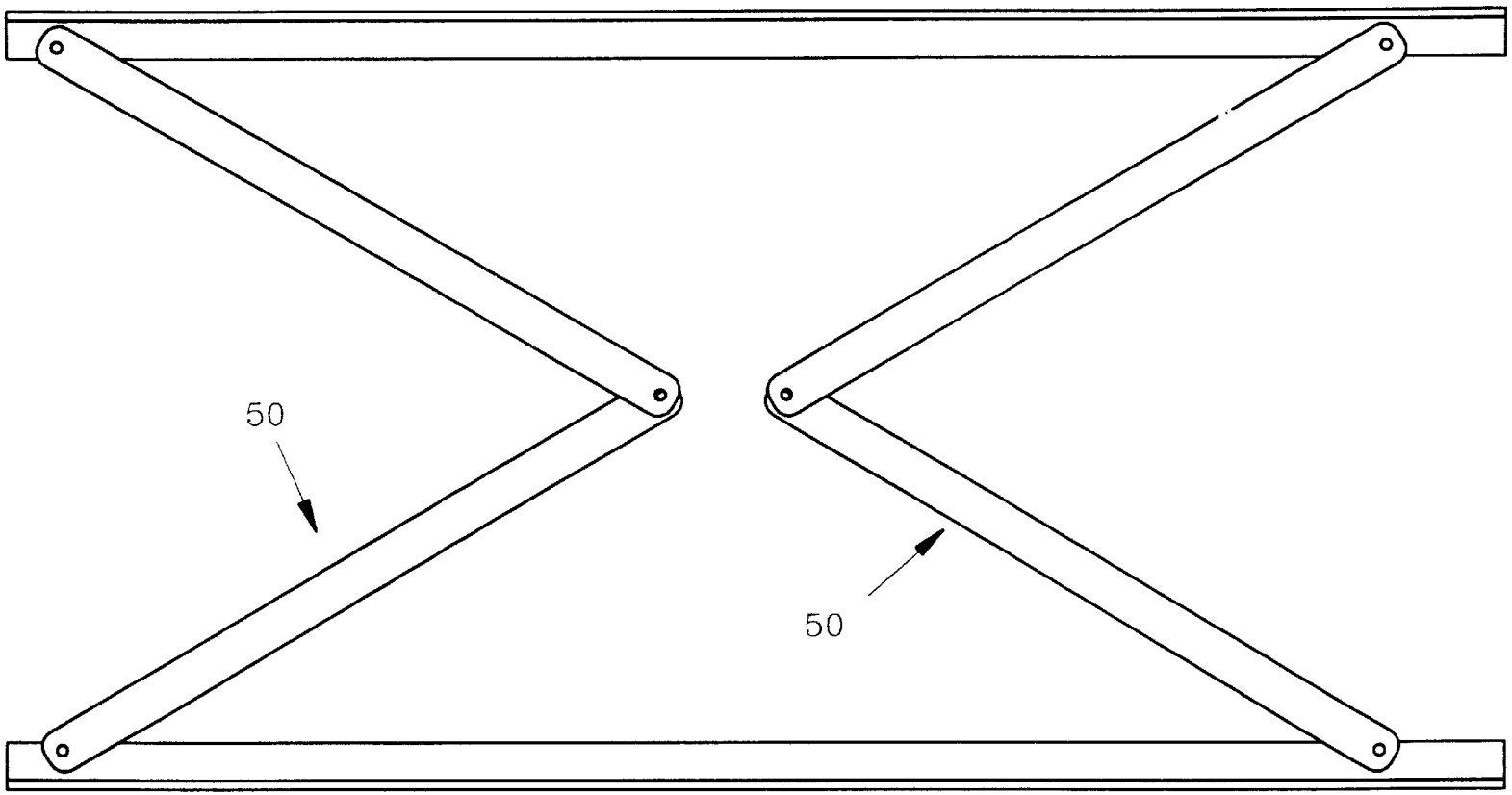
FIG. 8 illustrates a pair of the v-shaped slats on a narrow bed frame.
Figure 9:
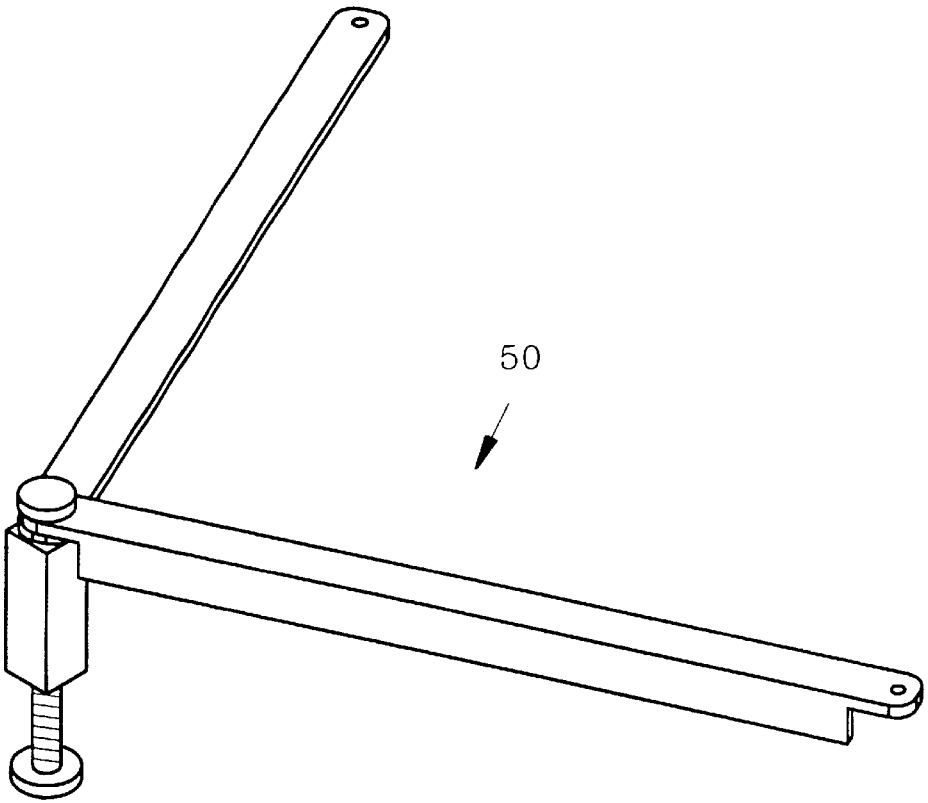
FIG. 9 shows a rear view of the v-shaped slat with the leg attached.
Figure 10:
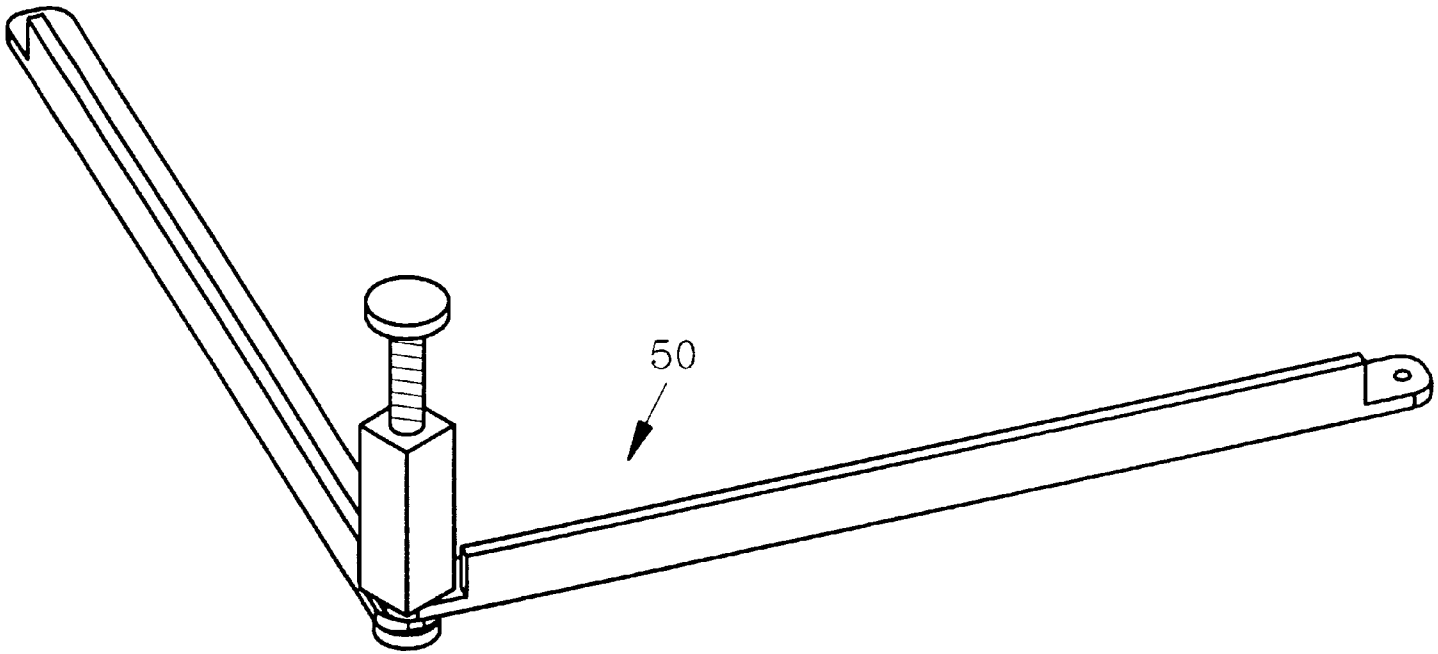
FIG. 10 pictures an inverted view of the v-shaped slat, also with the leg attached.

In FIG. 7, a wide bed frame is shown which may have a width of 198 cm whereas in FIG. 8 a pair of slats 50 are shown in a relatively narrow bed frame perhaps having a width of 90 cm. It is important that the bed frame properly support a mattress and/or box springs and as such a plurality of v-shaped slats 50 can be employed as required. In FIG. 9 a rear view of slat 50 is seen while in FIG. 10 an inverted view is illustrated with an adjustable leg attached.

Leg 55 which is attached to slat 50 is a standard threadably adjustable leg as used in the furniture industry and provides additional support against the floor or other surface on which the bed frame is located. Slat 50 is formed of suitably dimensioned angle iron for strength and rigidity to support mattresses and box springs of various weights and load bearing capacity.

Figure 11:
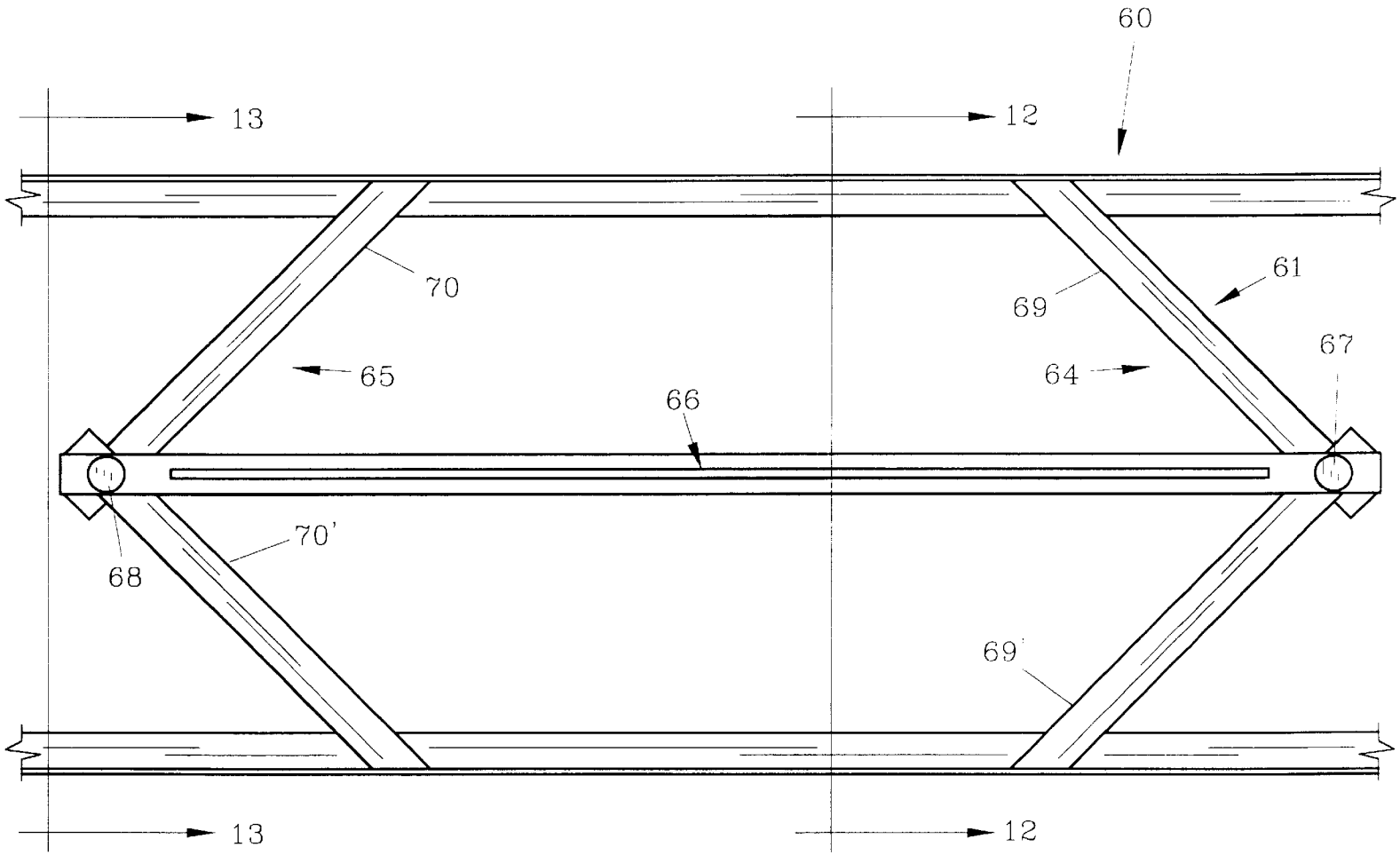
FIG. 11 features yet another embodiment of a mattress support utilizing a pair of v-shaped slats which are connected.
Figure 12:
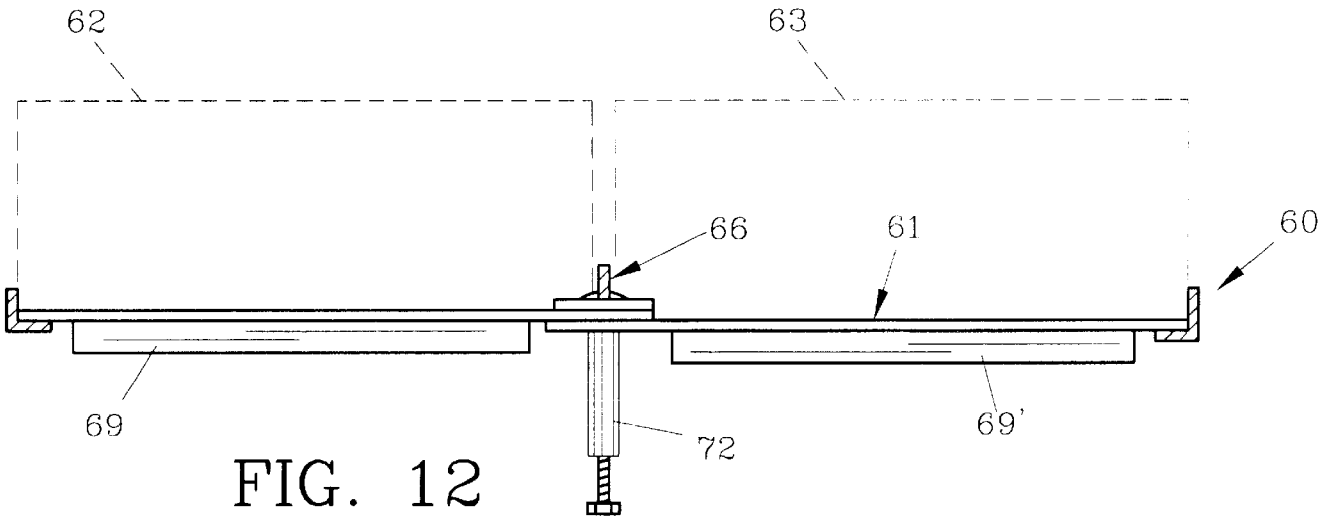
FIG. 12 shows the mattress support of FIG. 11 along lines 12—12 therein.
Figure 13:
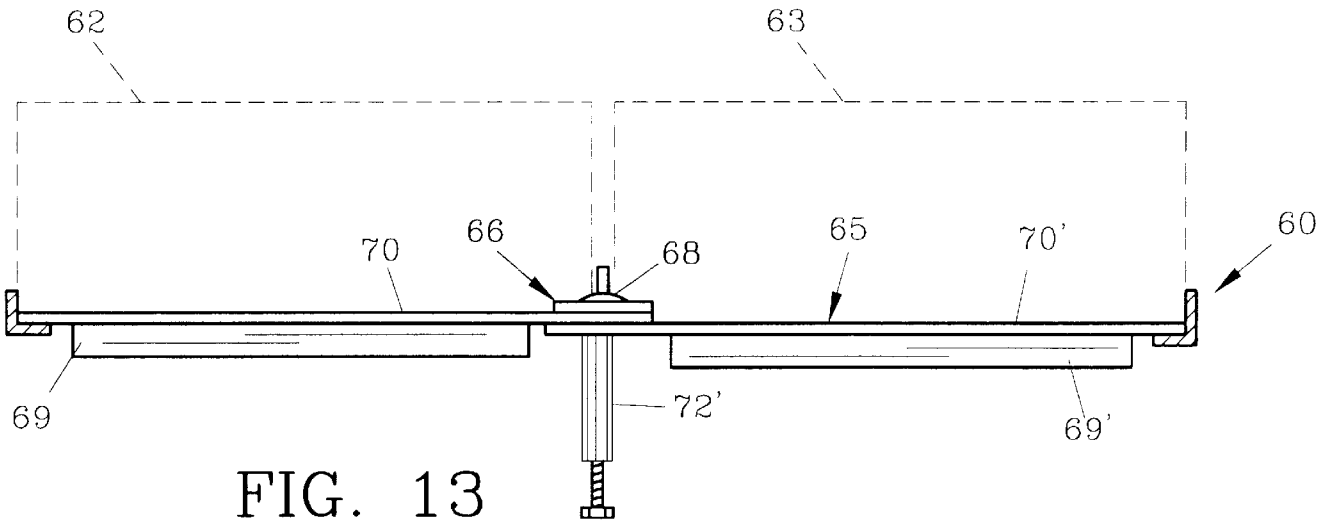
FIG. 13 depicts another view of the embodiment as seen in FIG. 11 along lines 13—13 therein.

In yet another embodiment of the invention as seen in FIG. 11, a wide bed frame 60 is shown in fragmented fashion with mattress support 61 thereon. Mattress support 61 may for example provide support to a pair of mattresses or box springs 62, 63 shown in ghost fashion in FIGS. 12 and 13. Mattress support 61 includes pairs of v-shaped slats 64, 65 which are connected by inverted t-shaped divider 66. Inverted t-shaped divider 66 is connected to v-shaped slat 64 by threaded member 67 which passes through apertures (not seen) in v-shaped divider 66 and longitudinal members 69, 69'. Inverted threaded member 68 likewise passes through apertures (not seen) in divider 66, and in longitudinal members 70, 70'. Threaded members 67, 68 are received by rounded legs 72, 72' as hereinbefore described regarding standard leg 55. V-shaped slat 64, 65 can be rotatably adjusted as shown in FIG. 6 for a variety of bed widths. By threadably tightening member 66 into leg 72 through longitudinal members 69, 69' a sturdy mattress support is provided for wide bed frames utilizing a pair of side-by-side mattresses such as seen in FIGS. 12 and 13.

Figure 14:
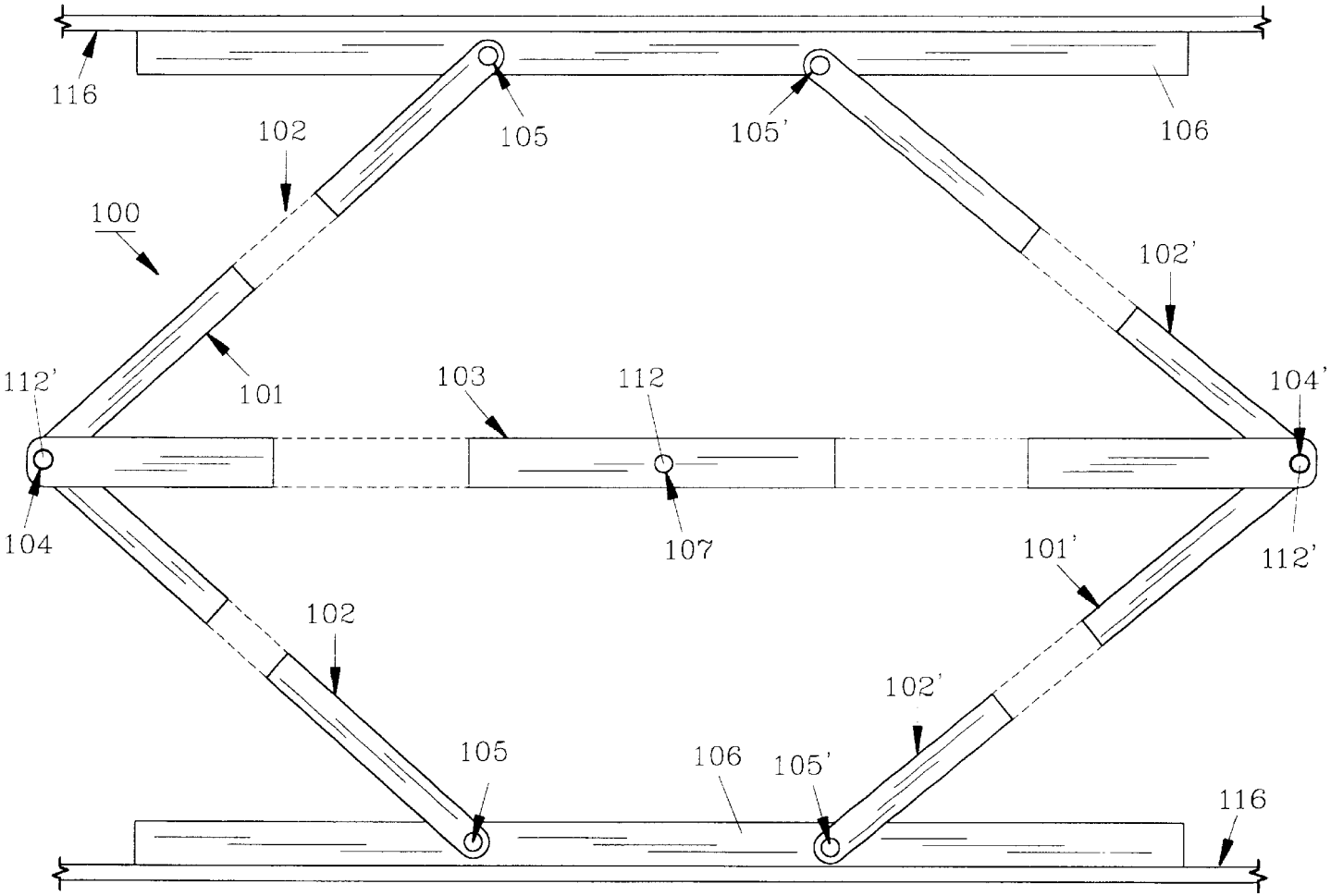
FIG. 14 illustrates a top schematic view of a preferred embodiment of the invention utilizing a pair of opposing v-shaped slats on a typical bed frame.

In FIG. 14, a top schematic view of a preferred embodiment of the invention is shown. FIG. 14 pictures mattress support 100, in fragmented form, comprising a pair of V-shaped slats 101 and 101' connected to the cleats of bed side rails 106 of typical bed frame 116 at holes 105 and 105', respectively. Preferably, bolts are inserted through holes 105 and 105' into a similarly sized opening located on the cleats of side rails 106 and held into place by opposing nuts, however, other like connecting means can be employed such as screws, pins or the like.

Figure 15:
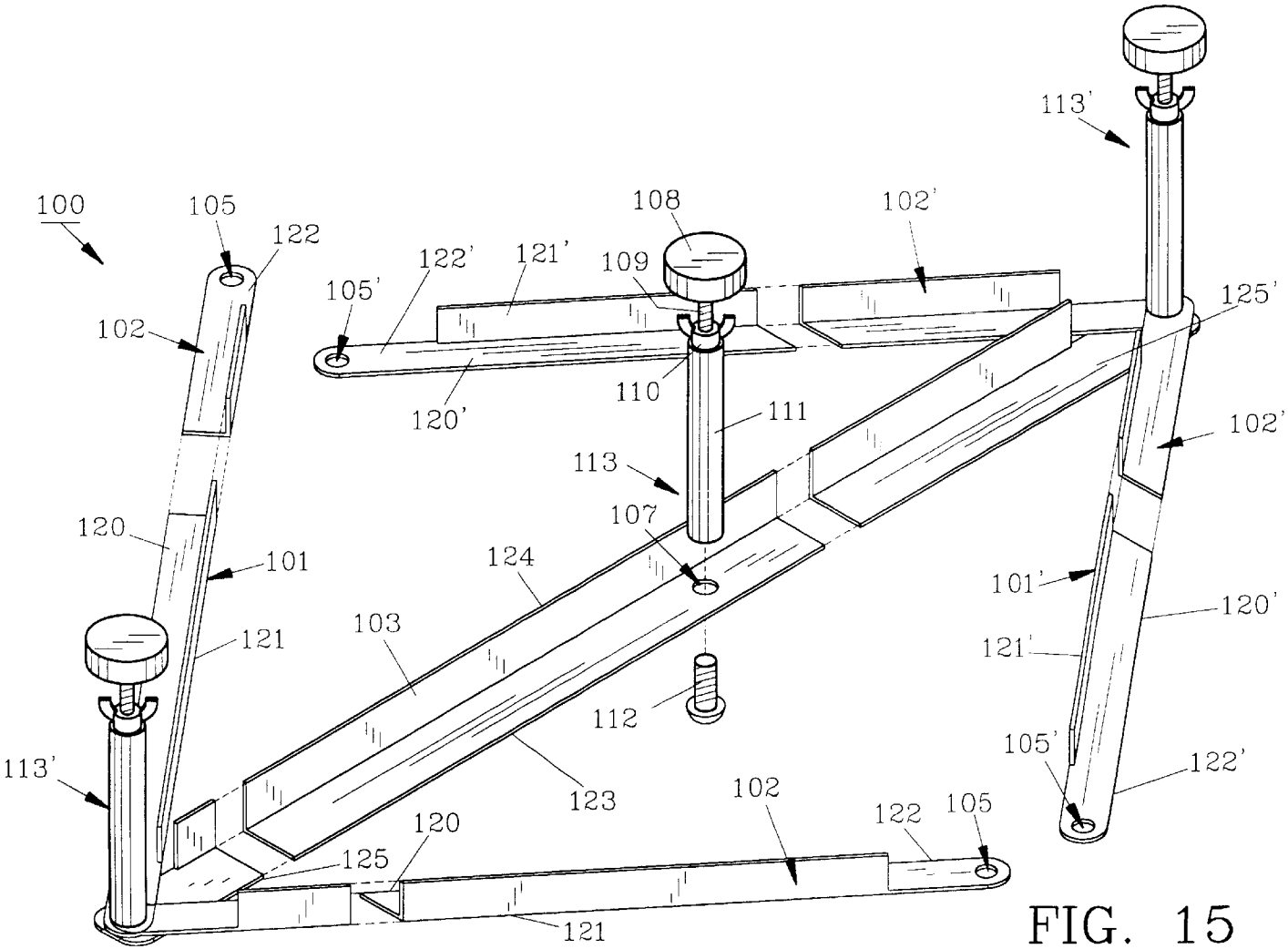
FIG. 15 features an inverted perspective view of the invention shown in FIG. 14 as removed from the bed frame.

Slats 101 and 101' each comprise a pair of longitudinal members 102 and 102', respectively. Longitudinal members 102 and 102' are made from angle iron and have flat, upper horizontal portions 120 and 120' and downwardly depending portions 121 and 121', as seen in FIG. 15. The terminal ends of each longitudinal member include planar flanges 122 and 122' to rest on the cleats of the bed frame side rails. Flanges 122 and 122' are preferably no more than one-eighth inch (⅛") thick and allow for the box springs to rest flush on the rail cleat. Flanges 122 and 122' define holes 105 and 105' therethrough for rigid affixation to the side rail cleats if desired by a bolt, pin or screw. Center divider 103 is likewise made from angle iron and has a flat, upper horizontal portion 123 and downwardly depending portion 124. The terminal ends of center divider 103 include planar flanges 125 and 125'. Flanges 125 and 125' define holes 104 and 104', respectively. Longitudinal members 102 and 102' are pivotally connected to center divider 103 at holes 104 and 104', respectively. Longitudinal members 102 and 102' are positioned so as to connect with bed rails 106 (which are parallel to center divider 103) at holes 105 and 105', respectively, each forming a V-shape pointing outward from the center of mattress support 100.

FIG. 15 shows an inverted perspective view of the preferred embodiment featured in FIG. 14, but removed from bed frame 116. Mattress support 100 is shown, in fragmented form, with adjustable legs 113 and 113'. Leg 113 is unmounted with threaded member 112 unattached, while legs 113' are removably connected to mattress support 100 at opposing ends of center divider 103. Leg 113 preferably has a circular base 108 connected to a cylindrical, tubular section 111 via threaded member 109. Wing nut 110 is threadably connected to threaded member 109, and provides a means for securing the adjustment of the selected height of leg 113 by hand, while leg 113 is attached to mattress support 100. To attach leg 113 to mattress support 100, tubular section 111 is placed over hole 107 on the underside of center divider 103, and threaded member 112 is inserted through hole 107 from the opposite side into tubular section 111 to make a threaded connection therebetween that can be easily tightened manually. Threaded member 112 is held in place by a lock washer (not seen).

Figure 16:
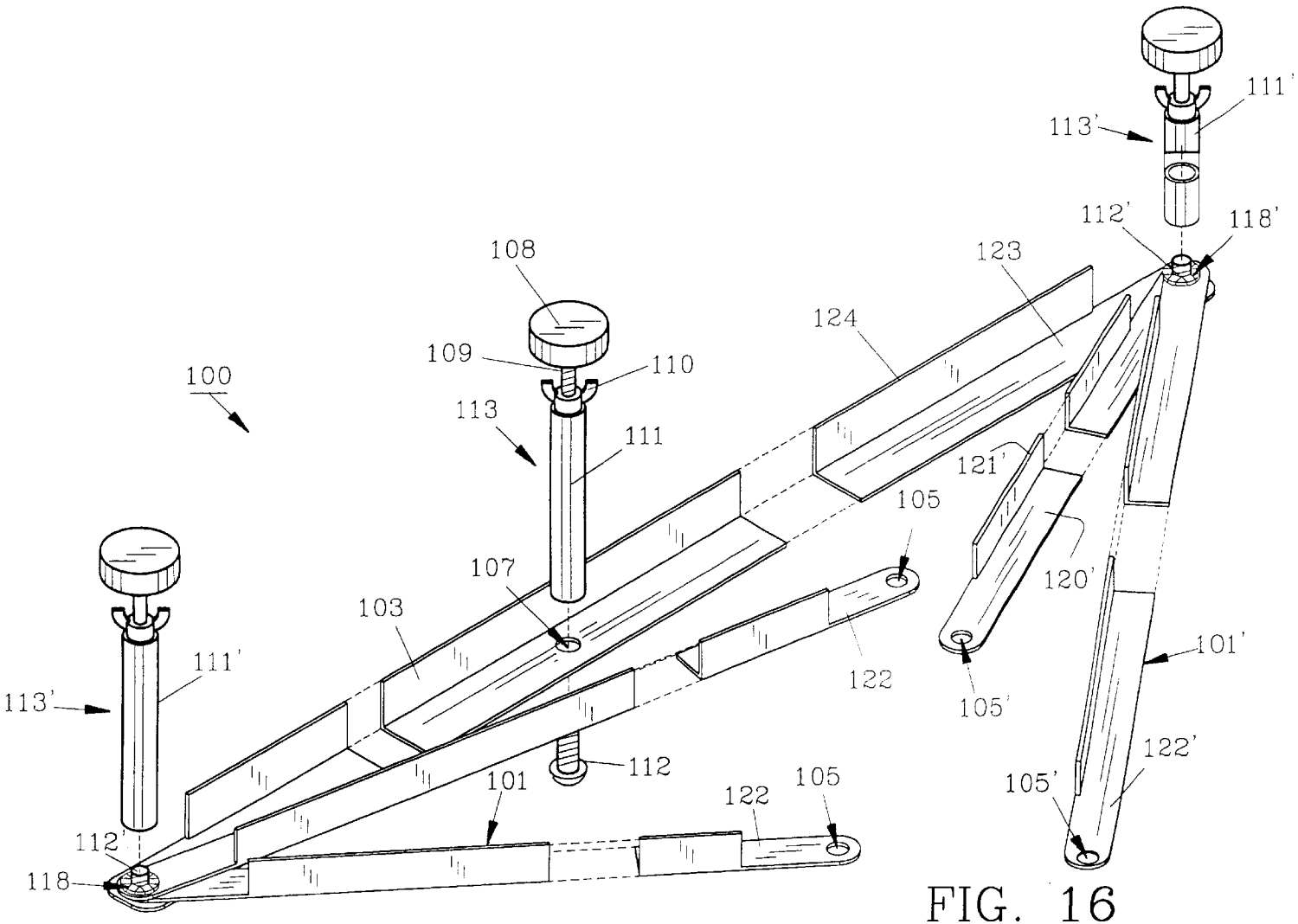
FIG. 16 pictures a different inverted perspective view of the invention shown in FIG. 15.

Legs 113' are of a like design and construction as leg 113 and are similarly connected to center divider 103 via threaded members 112'. Legs 113' are placed over holes 104 and 104' on the underside of center divider 103. Threaded members 112' are inserted through holes 104 and 104' from the opposite side. In addition, threaded members 112' are inserted through similar sized holes (not seen)in slats 101 and 101', defined by flanges 122 and 122'. Threaded members 112', protruding through the holes in slats 101, 101' and holes 104, 104' in center divider 103 are held in place with lock washers 118 and 118' and are then inserted into the tubular sections 111' of legs 113' to make threaded connections therebetween, as seen in FIG. 16. Slats 101 and 101', located between threaded members 112' and center divider 103, are held in place by the frictional engagement of the threaded connection. By releasing the frictional engagement between tubular sections 111' and threaded members 112', longitudinal members 102 and 102' of slats 101 and 101' are released (as shown in FIG. 16) and can be freely moved in various positions to accommodate beds of all sizes such as twin, full, queen or king.

Figure 17:
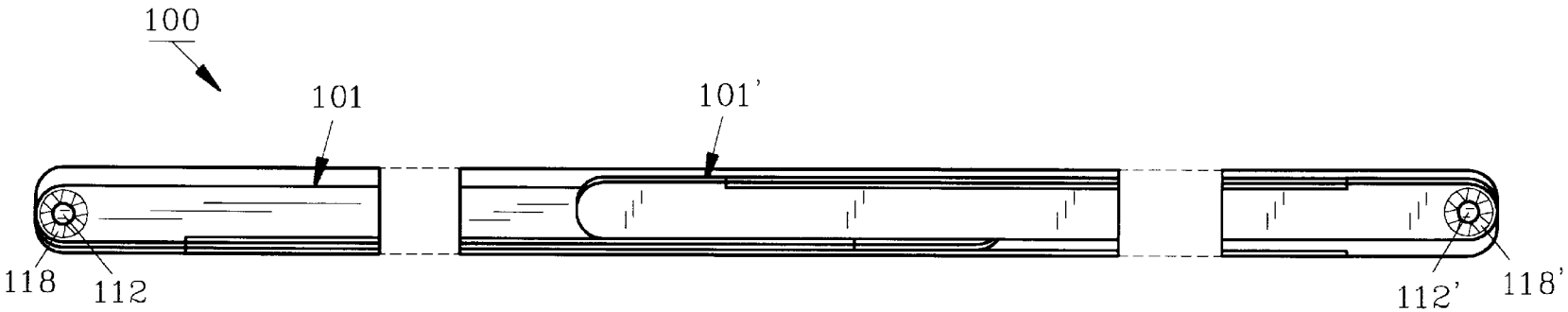
FIG. 17 demonstrates the invention of FIG. 16 in folded, fragmented form.
Figure 18:
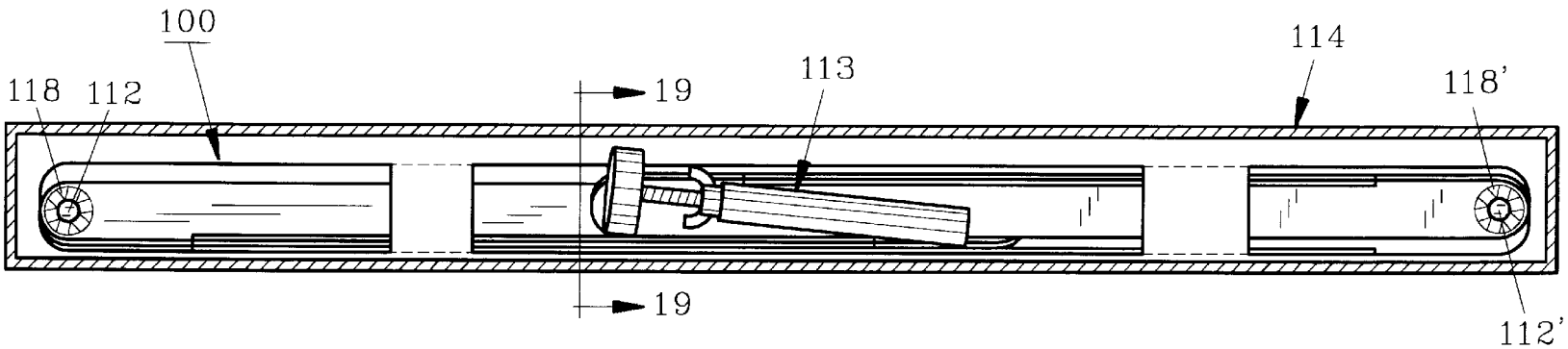
FIG. 18 shows the invention of FIG. 17, also in folded, fragmented form, contained in a shipping box.

Due to the pivotal connection described above, longitudinal members 102 and 102' of slats 101 and 101' can also be positioned parallel to center divider 103 to form a linear compact shape as shown in FIG. 17. When positioned in such a way, mattress support 100 can be contained in shipping box 114, along with unattached leg 113 as shown in FIGS. 18 and 19. (Although, only one leg is shown in FIGS. 18 and 19, all three legs can be contained in box 114 at once.) Mattress support 100 can be contained in shipping box 114 in a completely assembled state except for unattached legs 113 and 113'. Consequently, mattress support 100 can be removed from box 114 and easily, fully assembled by hand by attaching legs 113 and 113'.

A preferred embodiment of adjustable leg 117 comprises two cylindrical, tubular sections 111 and 119 connected to each other via threaded stud 115 held in place by lock washer 118 as shown in FIG. 20. Tubular sections 111 and 119 contain female threaded members 126 located at the upper and lower ends of the interior of tubular sections 111 and 119. If desired, one of the tubular sections can be removed and the leg can be used with only one tubular section, thereby greatly reducing the height of the leg. Furthermore, additional tubular sections can be employed by utilizing additional threaded studs in a similar manner. Consequently, the leg can be utilized in a great variety of heights, further enhancing the utility of the invention.

The preceding recitation is provided as an example of the preferred and alternate embodiments and is not meant to limit the nature or scope of the present invention or appended claims. As would be understood, angle iron is used due to its rigid nature as is needed here for relatively long spans to insure safety and comfort for the user.

I claim:

1. A mattress support comprising: a pair of slats, said slats formed from angle iron, each of said slats comprising a pair of longitudinal members, a center divider, said center divider attached to each of said slats, an adjustable leg, said adjustable leg attached to said center divider, said adjustable leg comprising a base, a first threaded member, said base connected to a first threaded member, a nut, said nut threadably connected to said first threaded member, a first tubular section having an upper end and a lower end, said first tubular section threadably connected to said first threaded member at said lower end of said first tubular section at a point above said nut, a second tubular section having an upper end and lower end, a threaded stud, said threaded stud connected to said lower end of said second tubular section and protruding therefrom, said second tubular section connected to said first tubular section via said threaded stud, and means for connecting said leg to said mattress support, said connecting means positioned at the upper end of said second tubular section.

2. The mattress support of claim 1 wherein said center divider has opposing planar ends, said slats attached at said opposing planar ends.

3. The mattress support of claim 2 further comprising first and second adjustable legs, said first and second legs attached at said opposing ends of said center divider.

4. The mattress support of claim 3 further comprising a third adjustable leg, said third adjustable leg attached at the proximate mid point of said center divider.

5. The mattress support of claim 1 wherein slats are pivotally attached to said center divider to fold coincidentally therewith.

6. The mattress support of claim 1 wherein each of said longitudinal members are pivotally attached to said center divider to fold coincidentally therewith.

7. The mattress support of claim 6, wherein said longitudinal members are parallel to said center divider so that said mattress support is of a straight, compact shape.

8. The mattress support of claim 7 in combination with a box, said box having a size sufficient to contain said mattress support.

9. The mattress support of claim 1 wherein each of said longitudinal members includes a flange to rest on the bed frame side rails.

10. The mattress support of claim 1, wherein said adjustable leg is removably attached to said center divider.

11. The adjustable leg of claim 1, wherein the height of said leg can be adjusted by hand while attached to said center divider.

12. The adjustable leg of claim 1, wherein said nut comprises a wing nut.

13. A method for installing a mattress support having a pair of slats and contained in a box, each of said slats having a pair of longitudinal members pivotally connected to opposing ends of a center divider, and an adjustable leg capable of being removably attached to said center divider, comprising the steps of:

a) removing said mattress support from said box, b) attaching said adjustable leg to said center divider, c) adjusting said leg to a desired height, d) placing said mattress support in an upright position on the floor supported by said leg, e) pivoting said longitudinal members of said slats so as to form a V-shape with each slat, f) tightening the pivotal connection between said slats and said center divider so as to hold said slats in respective V-shapes, and g) placing a mattress on said mattress support.

14. The method of claim 13, further comprising the step of connecting said slats to side rails of a bed frame.

15. A method for installing a mattress support having a pair of slats and contained in a box, each of said slats having a pair of longitudinal members pivotally connected to opposing ends of a center divider, and an adjustable leg removably attached to said center divider and having multiple tubular sections releasably connected to each other, comprising the steps of:

a) removing said mattress support from said box, b) connecting a desired number of tubular sections of said adjustable leg so as to obtain a desired height of said leg, c) attaching said adjustable leg to said center divider, d) placing said mattress support in an upright position on the floor supported by said leg, e) pivoting said longitudinal members of said slats so as to form a V-shape with each slat, f) tightening the pivotal connection between said slats and said center divider so as to hold said slats in respective V-shapes, and g) placing a mattress on said mattress support.

16. A leg for a mattress support comprising a base, a first threaded member, said base connected to said first threaded member, a nut, said nut threadably connected to said first threaded member, a first tubular section having an upper end and a lower end, said first tubular section threadably connected to said first threaded member at said lower end of said first tubular section at a point above said nut, a second tubular section having an upper end and lower end, a threaded stud, said threaded stud connected to said lower end of said second tubular section and protruding therefrom, said second tubular section connected to said first tubular section via said threaded stud, and means for connecting said leg to said mattress support, said connecting means positioned at the upper end of said second tubular section.

17. The leg of claim 16 wherein said nut comprises a wing nut.

18. A mattress support comprising: a pair of slats, each of said pair of slats comprising a pair of longitudinal members, a center divider, said pair of slats joined to said center divider at opposite ends of said center divider, each of said pairs of longitudinal members pivotal about said center divider to accommodate mattresses of different widths by forming V-shapes, a leg, said leg attached to said center divider between said pair of slats.

* * * * *